US006621389B2

(12) United States Patent
Grumel et al.

(10) Patent No.: US 6,621,389 B2
(45) Date of Patent: Sep. 16, 2003

(54) ELECTRICAL SWITCHGEAR UNIT EQUIPPED WITH A MOTORIZED CONTROL AND PROCESS FOR OPERATING SUCH A SWITCHGEAR UNIT

(75) Inventors: Christophe Grumel, Lans en Vercors (FR); Marc Serpinet, Montchaboud (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/337,308

(22) Filed: Jan. 7, 2003

(65) Prior Publication Data

US 2003/0137373 A1 Jul. 24, 2003

(30) Foreign Application Priority Data

Jan. 24, 2002 (FR) ..... 02 00857

(51) Int. Cl.[7] ..... H01H 3/00; H01H 51/00
(52) U.S. Cl. ..... 335/71; 335/68
(58) Field of Search ..... 335/68–77; 218/153, 218/154

(56) References Cited

U.S. PATENT DOCUMENTS 4,990,873 A * 2/1991 Grunnert et al. ..... 335/68
5,323,131 A * 6/1994 Castonguay ..... 335/68
6,326,870 B1 * 12/2001 Larranaga et al. ..... 335/68
6,380,829 B1 * 4/2002 Castonguay et al. ..... 335/68
6,423,917 B2 * 7/2002 Narayanan et al. ..... 335/68

FOREIGN PATENT DOCUMENTS

EP 0 802 549 A2 10/1997

* cited by examiner

*Primary Examiner*—Tuyen T. Nguyen
(74) *Attorney, Agent, or Firm*—Parkhurst & Wendel, L.L.P.

(57) ABSTRACT

A circuit breaker is equipped with a motorized control acting on an operating member oscillating between a loaded position and a closed position, passing via a closing dead point position. When the unit is open or reset by means of the motorized control, the operating member is moved to an indexed position close to the closing dead point position, so as to minimize the closing time. The circuit breaker also has an opening dead point position. To minimize the opening-closing cycle time, the motor drives the operating member from the closed position to an indexed turning position situated between the opening dead point position and the loaded position, before changing direction.

15 Claims, 13 Drawing Sheets

ELECTRICAL SWITCHGEAR UNIT EQUIPPED WITH A MOTORIZED CONTROL AND PROCESS FOR OPERATING SUCH A SWITCHGEAR UNIT

BACKGROUND OF THE INVENTION

The invention relates to an electrical switchgear unit, for example a circuit breaker, equipped with a motorized control performing closing and, possibly, opening and resetting of the circuit breaker mechanism.

STATE OF THE PRIOR ART

In the document U.S. Pat. No. 3,171,920 an electrical circuit breaker of the molded case type equipped with an operating handle is described, on which circuit breaker a motorized module for driving the handle is assembled. The module comprises a motor driving an endless screw operating in conjunction with a nut fixedly secured to the handle. The motor is of AC type comprising a first winding serving the purpose of driving the rotor in a first direction and a second winding for driving in the opposite direction. A changeover switch enables one or the other of the windings to be connected selectively to an electrical power source by means of a first and a second circuit branch each comprising a control push-button. The motor and endless screw are fitted in a frame fixed to the circuit breaker case. A guiding system gives the screw a small degree of freedom in translation with respect to the frame and to the stator of the motor. Springs urge the screw to a middle position. To close the circuit breaker from an open position of the handle, the closing push-button is actuated and the motor is supplied in a first running direction so as to drive the handle at high speed to the closed position. On its path, the handle passes without stopping via a closing dead point position beyond which the toggle mechanism of the circuit breaker rocks abruptly to the closed position. The motor continues its movement, without stopping, until the nut reaches the end of travel. The screw, continuing to turn, performs a slight translation against the bias of the return springs and makes the changeover switch change position, cutting the power supply to the motor. To reset the circuit breaker, the opening push-button is actuated and the motor is supplied in the second running direction to drive the handle without stopping to a loaded position situated slightly beyond the open position. When the nut reaches an end-of-travel stop, further rotation of the motor causes a slight translation of the screw and makes the changeover switch change position, which cuts the power supply to the motor. By means of this complex device, it is ensured on the one hand that the handle duly reaches its end-of-travel positions, and on the other hand that the inertia of the motor can be absorbed when translation of the screw takes place. In the document U.S. Pat. No. 3,171,920 a slight variation of the above principle is presented.

In the document EP 0,802,549 there is described a removable module for motorized driving of a handle of an electrical switchgear unit, a circuit breaker or contactor. The module comprises a motor that drives an endless screw operating in conjunction with a slide rack fixedly secured to the handle of the electrical switchgear unit. The slide rack moves in translation between two end-of-travel positions without any intermediate stopping. The slide rack comprises a window in which the handle of an operating selector switch is inserted. When the slide rack approaches either one of its end-of-travel positions, the edge of the window drives the handle of the operating changeover switch and makes the changeover switch change position, opening the motor power supply circuit. This arrangement enables the motor to be controlled with a single control changeover switch.

In these devices, the closing time following a closing order is conditioned by the distance to be covered between the loaded position and the closing dead point position, which is non-modifiable constructive data of the switchgear unit mechanism. To reduce the closing time, powerful motors therefore have to be provided and the kinematic linkage transmitting the movement of the motor to the switchgear unit handle has to be optimized so as to minimize the energy dissipated when closing takes place. Consequently, performance is obtained at the price of large dimensions and high cost.

OBJECT OF THE INVENTION

The object of the invention is therefore to remedy the shortcomings of the state of the art so as to propose an electrical switchgear unit equipped with a motorized operating module of low power and small dimensions enabling a short closing time to be obtained.

According to the invention, these objectives are achieved by means of an electrical switchgear unit comprising:

- a pair of separable contact means comprising at least one movable contact means movable between a contact position and a separated position;
- an opening and closing mechanism of the switchgear comprising:
  - a primary member movable in a closing direction from a loaded position to a closed position passing via an intermediate closing dead point position, the movable contact means being in the separated position when the primary member is in the loaded position,
  - an energy storage spring arranged in such a way that the primary member loads the storage spring when passing from the loaded position to the closing dead point position, and that the storage spring discharges driving the movable contact means to the contact position when the primary member passes beyond the closing dead point in the closing direction;
- an electric motor controlled by control means;
- an irreversible kinematic transmission system between the electric motor and the primary member, such that the electric motor can drive the primary member but the primary member can not drive the electric motor, the motor running in a closing direction to drive the primary member in the closing direction;
- characterized in that the control means comprise means for detecting passage of the primary member via an indexed intermediate stopping position between the loaded position and the closing dead point position and for stopping the motor when the motor drives the primary member in the closing direction and the primary member reaches the indexed stopping position.

As the handle already covers a part of the travel between the loaded position and the closing dead point position before the closing order is given, the distance remaining to be covered after the closing order is smaller and requires less energy.

Preferably, the indexed stopping position is closer to the closing dead point position than to the loaded position.

According to one embodiment, the control means comprise an auxiliary switch changing state when the primary member passes via the indexed stopping position.

Advantageously, the control means comprise means for detecting the fact that the primary member is in the closed position whereas the motor is controlled to run in the closing direction, and for stopping the motor in this case. This detection can be performed for example by an auxiliary end-of-travel micro-contact. If the motor is a stepper motor, detection can be achieved by determining the position of the motor. According to another, particularly simple, reliable and compact alternative embodiment, the motor is a DC motor supplied by a supply current controlled by the control means, and the control means comprise means for detecting the fact that the intensity of the supply current remains higher than a preset threshold during a preset time whereas the motor is supplied to run in the closing direction, and for interrupting the power supply of the motor in this case.

Commanding opening of the circuit breaker in the phase preceding preparation for closing also has to be provided for. Thus:

the primary member is movable in an opening direction that is the reverse of the closing direction, from the closed position to the setting position, passing via an intermediate opening dead point position, the energy storage spring loading when passing from the closed position to the opening dead point position when the movable contact is in the contact position and discharging driving the movable contact means to the separated position when the primary member continues its movement in the opening direction beyond the opening dead point position;

the motor is mobile in an opening direction that is the reverse of the closing direction, to drive the primary member in the opening direction;

the control means comprise means for detecting the fact that the primary member, driven by the motor in the opening direction, passes via an indexed turning position, and for reversing the direction of rotation of the motor in this case.

According to one embodiment, the indexed turning position is the loaded position. The motor is a DC motor supplied by a supply current controlled by the control means, and the control means comprise means for detecting the fact that the intensity of the supply current of the motor remains higher than a preset threshold during a preset time whereas the motor is supplied to run in an opening direction that is the reverse of the closing direction, and for changing the direction of rotation of the motor in this case. The switchgear unit is then particularly simple and reliable, on account of the small number of sensors.

According to another embodiment, the indexed turning position is an intermediate position between the opening dead point position and the loaded position, closer to the opening dead point position than to the loaded position. The movement of the primary member in the opening direction, and therefore the time preceding reclosing, is then minimized.

Another feature of the invention relates to a process for operating an electrical switchgear unit comprising:

a pair of separable contact means, comprising at least one movable contact means movable between a contact position and a separated position;

an opening and closing mechanism of the switchgear unit, comprising:

a primary member movable in a closing direction from a loaded position to a closed position passing via an intermediate closing dead point position, the movable contact means being in the separated position when the primary member is in the loaded position, an energy storage spring arranged in such a way that the primary member loads the storage spring when passing from the loaded position to the closing dead point position, and that the storage spring discharges driving the movable contact means to the contact position when the primary member passes beyond the closing dead point in the closing direction;

an electric motor controlled by control means, the motor running in a closing direction to drive the primary member in the closing direction;

process that comprises an opening procedure of the switchgear unit comprising: a preparing for closing stage, wherein the motor drives the primary member in the closing direction up to an indexed intermediate stopping position situated between the loaded position and the closing dead point position, and stops in the intermediate stopping position.

Advantageously, the opening procedure comprises in addition an opening stage preceding the preparing for closing stage and wherein the movable contact means is moved to the separated position and wherein the motor drives the primary member in an opening direction opposite to the closing direction up to an indexed turning position.

According to one embodiment, the indexed turning position is the loaded position.

To minimize the opening time, it is provided that the mechanism comprises in addition: a latching member and a trip latch. The latching member is movable between a latched position and an unlatched position, and is in the latched position when the movable contact means is in the contact position. The trip latch is operated by an actuator and performs latching of the latching member in the latched position, the storage spring tending to simultaneously drive the latching member from the latched position to the unlatched position and the movable contact means from the contact position to the separated position when the latch releases the latching member. With such a mechanism, it is provided that in the opening stage, the movable contact means is moved to the separated position by commanding the actuator which unlatches the latch to release the latching member. The opening time is thus minimized, and becomes independent from the power of the motor. However, the time required for an opening-closing cycle remains long, as the motor must move the primary member back to the resetting position before being able to order closing.

According to another embodiment, the indexed turning position is situated between the loaded position and an opening dead point position situated between the closing dead point position and the loaded position, the storage spring loading as it passes from the closed position to the opening dead point position when the movable contact is in the contact position and discharging driving the movable contact means to the separated position when the primary member continues its movement in the opening direction passing beyond the opening dead point to the indexed turning position. In this case, the response time to an opening order is longer and depends on the power of the motor. However, the opening-closing cycle time is then minimized as the movement of the primary member is minimized.

Preferably, it is provided that in response to a closing order subsequent to the opening order, the motor drives the primary member from the intermediate stopping position to the closed position.

BRIEF DESCRIPTION OF THE DRAWINGS

Other advantages and features will become more clearly apparent from the following description of particular embodiments of the invention given as non-restrictive examples only and represented in the accompanying drawings in which.

DETAILED DESCRIPTION OF AN EMBODIMENT

Figure 1:
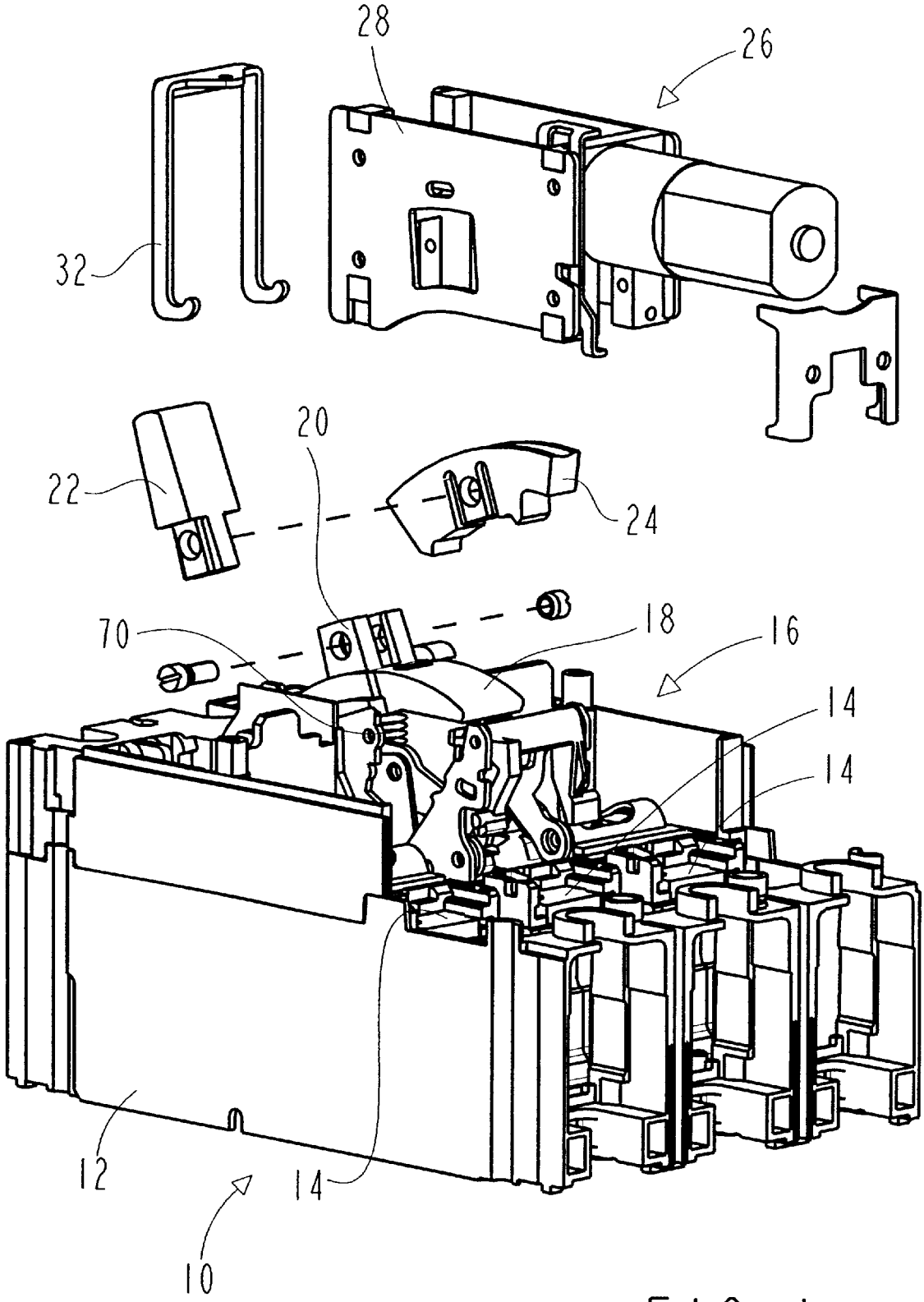
FIG. 1 represents an exploded view of the components of an electrical switchgear unit according to the invention.

With reference to FIG. 1, a switchgear unit 10, in this instance a three-phase circuit breaker of molded case and double-breaking type, comprises, inside a case 12 made of insulating plastic material the cover whereof has been purposely omitted in the drawings to simplify presentation, breaking cartridges 14 and their drive mechanism 16. The mechanism is equipped with a rocking operating member 18. This operating member has the general shape of a cylinder sector and is provided with a radial end-piece 20 whereon either a crank-pin 22 or a bevel gear 24 sector can be alternatively fixed as required. The crank-pin 22 is fitted in the case where the unit is intended for manual use, which will not interest us in the rest of the description. The bevel gear 24 on the other hand enables the operating member to be connected to a removable motorized module 26. This module 26 comprises a support frame 28 formed by two flanges fixed to a frame of the mechanism by means of a fork 32 and securing screws not shown in the figures.

Figure 2:
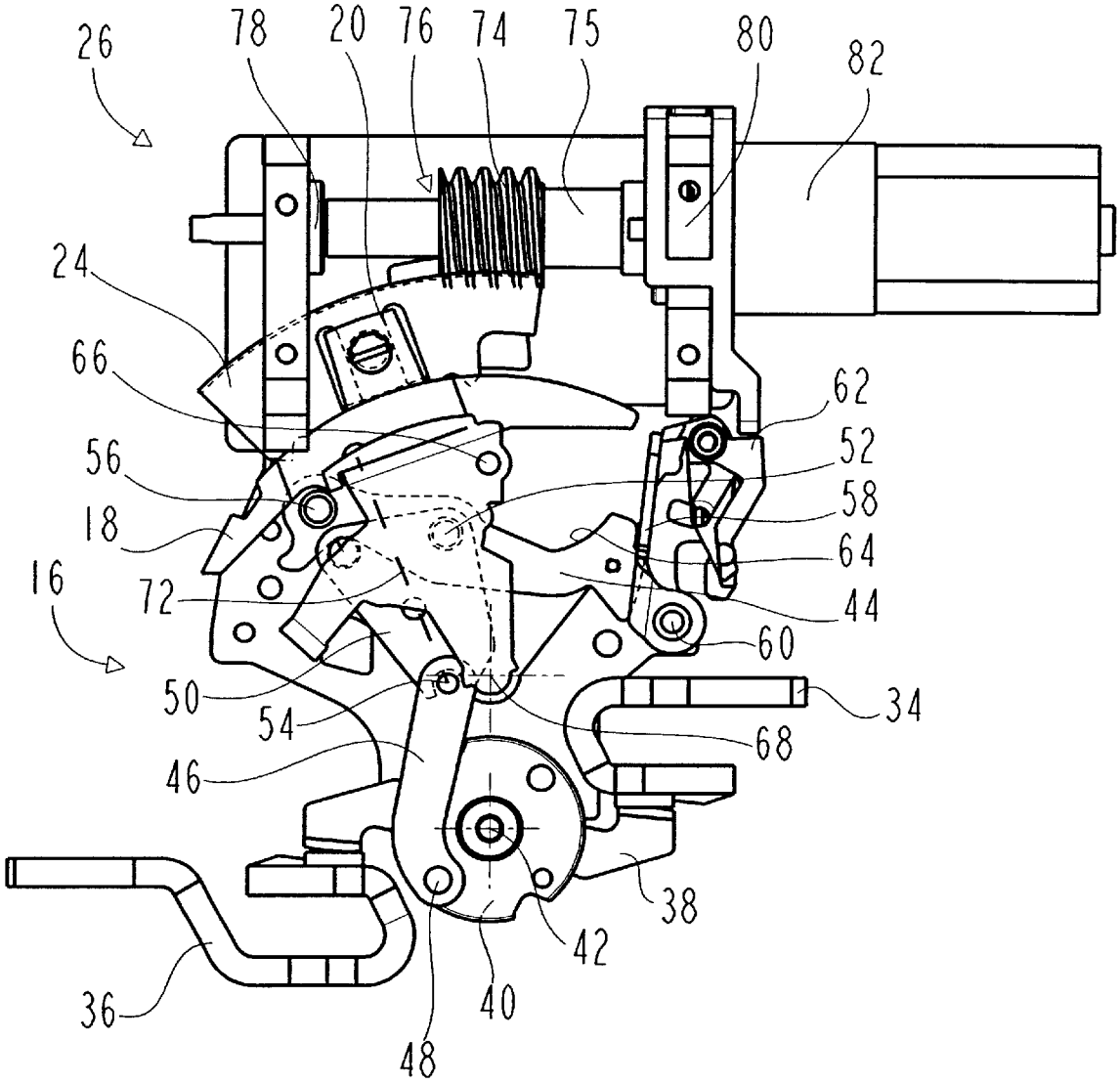
FIG. 2 represents a cross-sectional view of the unit of FIG. 1, in a closed position of the unit.

The moving parts of the circuit breaker, of its drive mechanism 16 and of the motorized module 26 can be seen in FIG. 2 in cross-section. The case 12 has been deliberately omitted to simplify representation.

Figure 3:
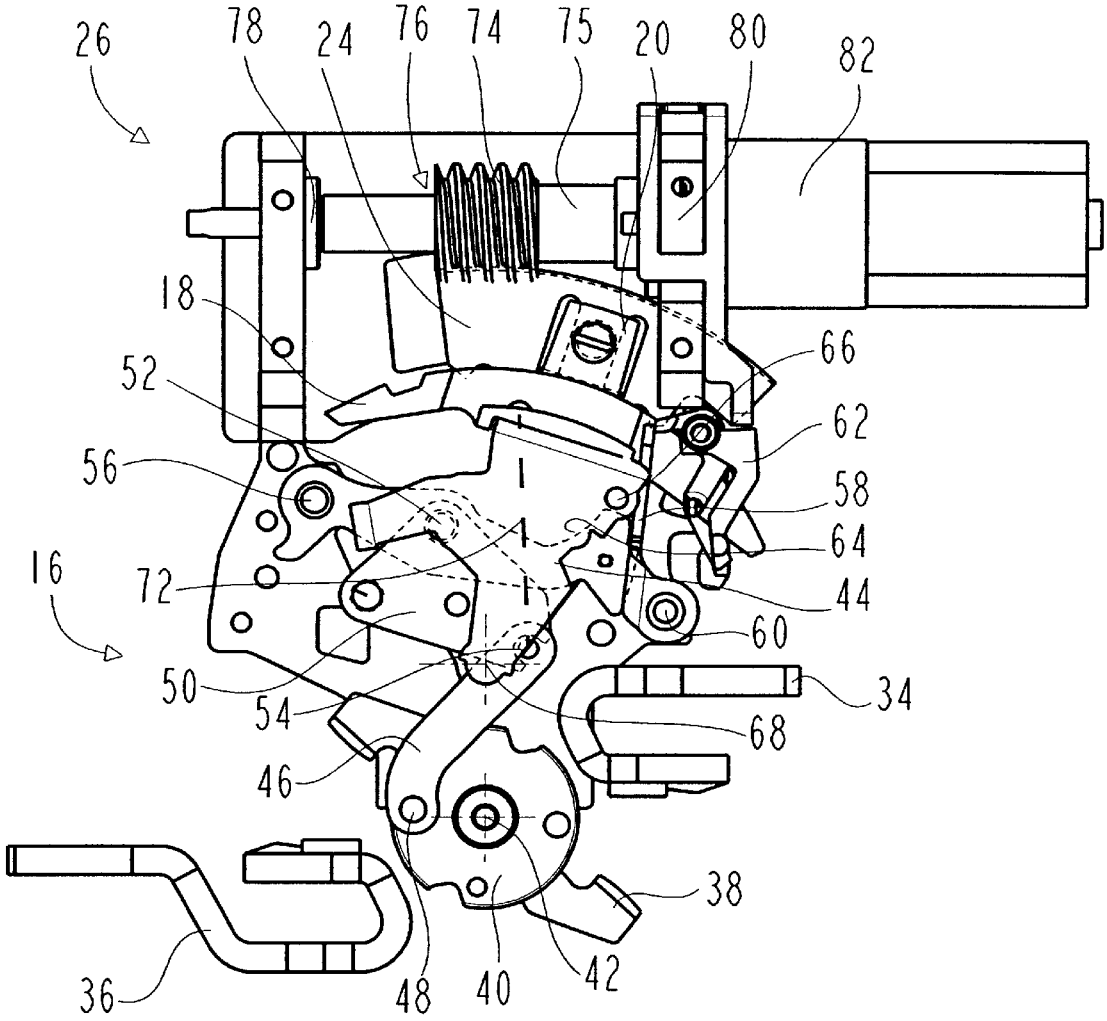
FIG. 3 represents a similar view to that of FIG. 2, in an open, loaded position.
Figure 4:
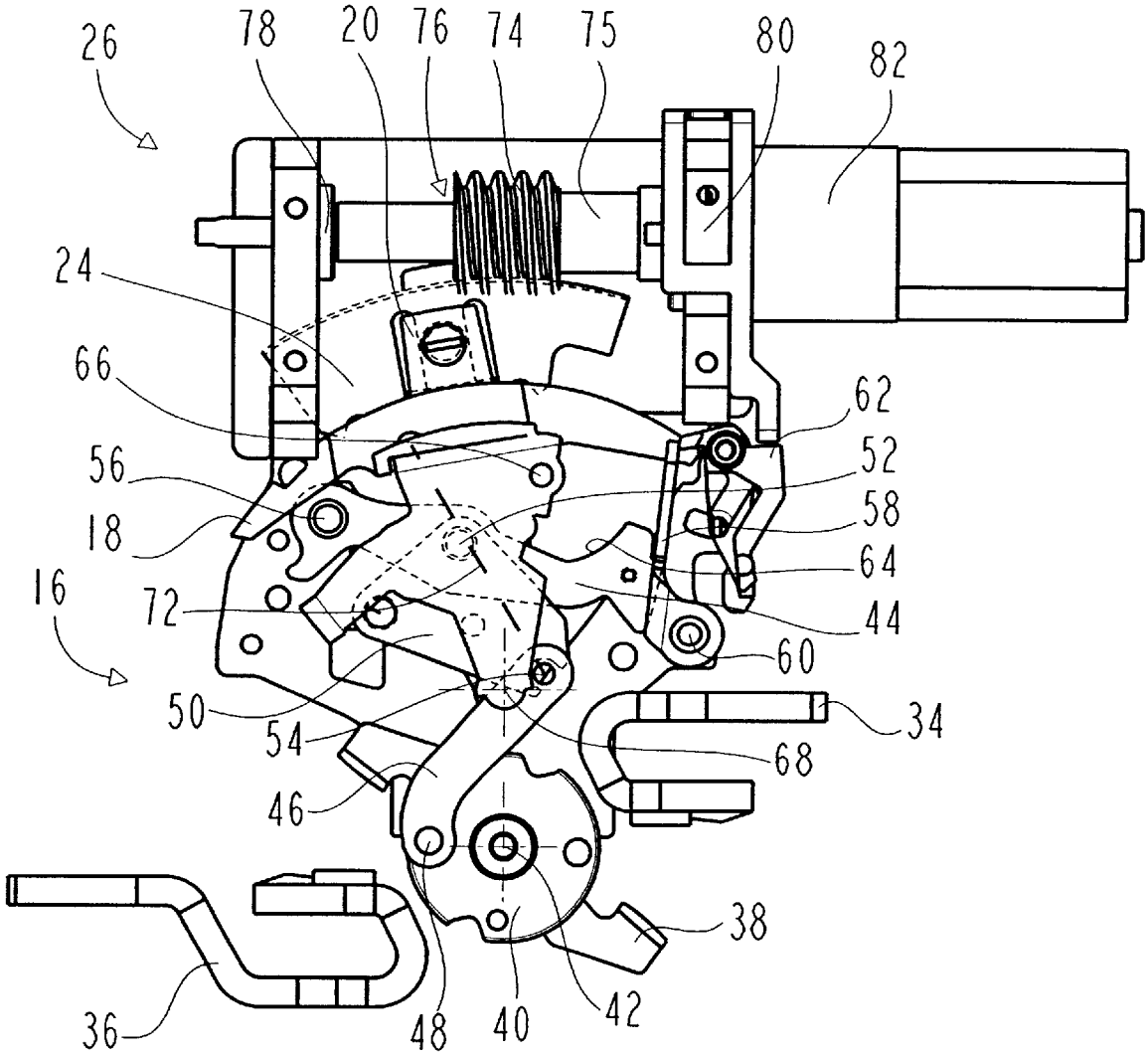
FIG. 4 represents a similar view to that of FIG. 2, in an indexed position called the "ready to close" position, intermediate between the open, loaded position of FIG. 2 and a closing dead point of the mechanism of the unit.
Figure 5:
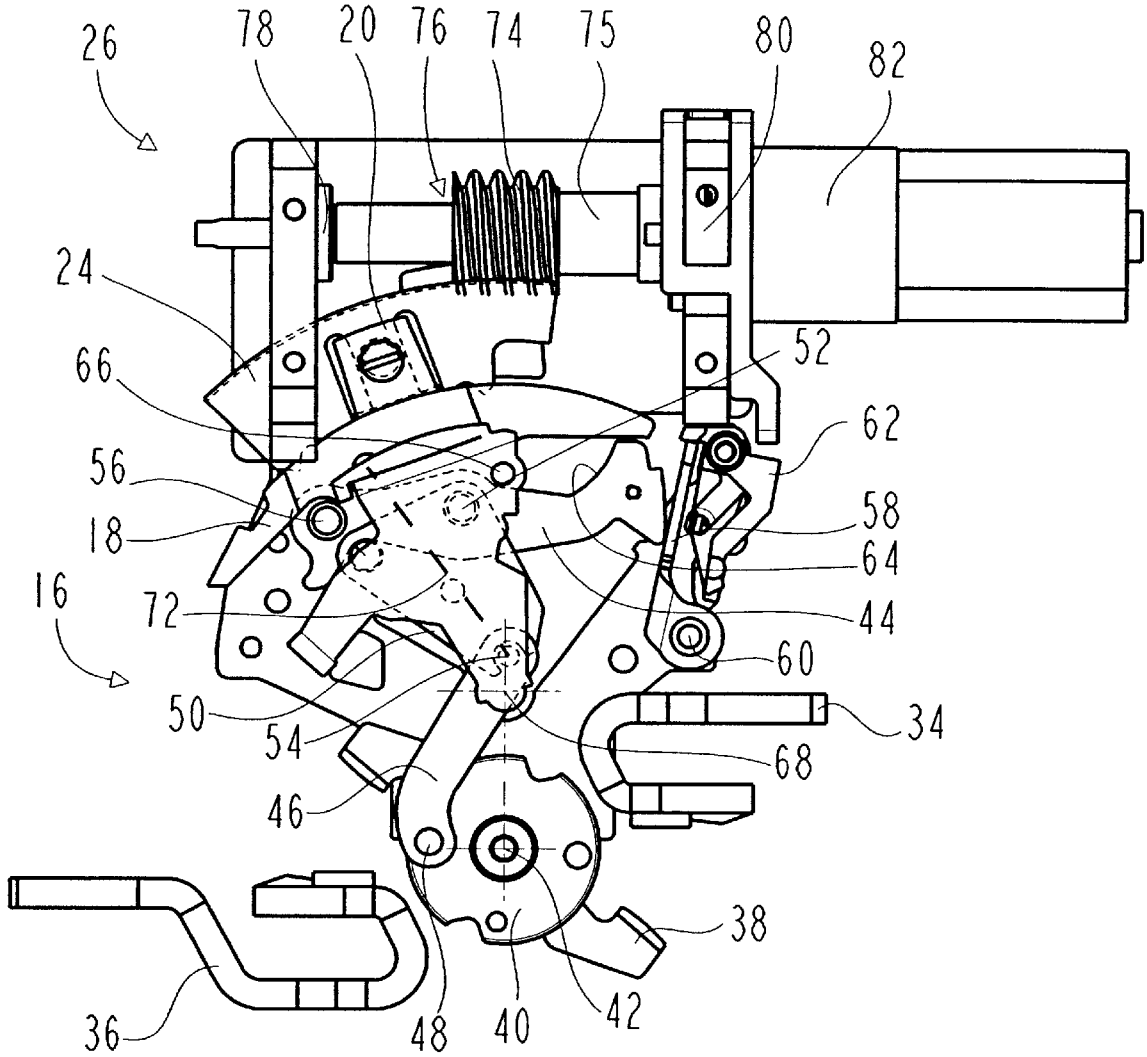
FIG. 5 represents a similar view to that of FIG. 2, in a tripped position of the unit.

The active parts of the breaking cartridge are formed by two fixed power connecting strips 34, 36 curved to form a U shape, and a bridging movable contact means 38 represented in the separated position in FIGS. 3 to 5, and in the contact position in FIG. 2, the latter position enabling closing of the power circuit and the current to flow between the two fixed strips 34, 36 by means of the contact bridge 38. The contact bridge 38 is supported by a rotary elemental bar 40 swivelling around a geometric axis 42 fixed with respect to the case. The elemental bar 40 is connected to a latch 44 of the mechanism by means of a connecting rod system formed by a lower rod 46 swivelling around a spindle 48 constituting a fixed geometric axis with respect to the bar, and an upper rod 50 swivelling around a fixed geometric axis 52 with respect to the latch 44, the two rods 46, 50 together forming a toggle joint articulated by an intermediate swivel pin 54. The latch 44 is itself mounted swivelling around a spindle 56 fixed with respect to the case, supported by the flanges of the mechanism. The free end of the latch 44 operates in conjunction with a notch made in a latching tongue 58 mounted swivelling around a spindle 60 fixed with respect to the frame of the mechanism. The tongue 58 is urged to its latching position by a return spring, not shown, and held in this position by a latching lever 62 swivelling whereof is controlled by an electromechanical actuator forming a constitutive part of a trip device, not shown. The latch 44 forms at its upper part a resetting cam 64 operating in conjunction with a roller 66 supported by the operating member 18, the operating member being itself mounted swivelling with respect to a geometric axis 68 fixed with respect to the frame of the mechanism and to the case. A tension spring 70 (FIG. 1) is stretched between the operating member 18 and the swivel pin 54 of the connecting rod system. To simplify representation, only the line of action 72 of the tension spring 70 has been materialized in FIGS. 2 to 5. This type of mechanism is well known as such to the man of the trade.

The bevel gear 24 is mounted on the end-piece 20 of the operating member 18 and engages on a threaded segment 74 of a rotary shaft 75 forming an irreversible endless screw transmission stage 76. The shaft is mounted in bearings 78, 80 of the frame of the motorized module 26 and keyed onto the end of the rotor shaft of a DC motor 82, the bearings 78, 80 not allowing any translation of the shaft.

Figure 6:
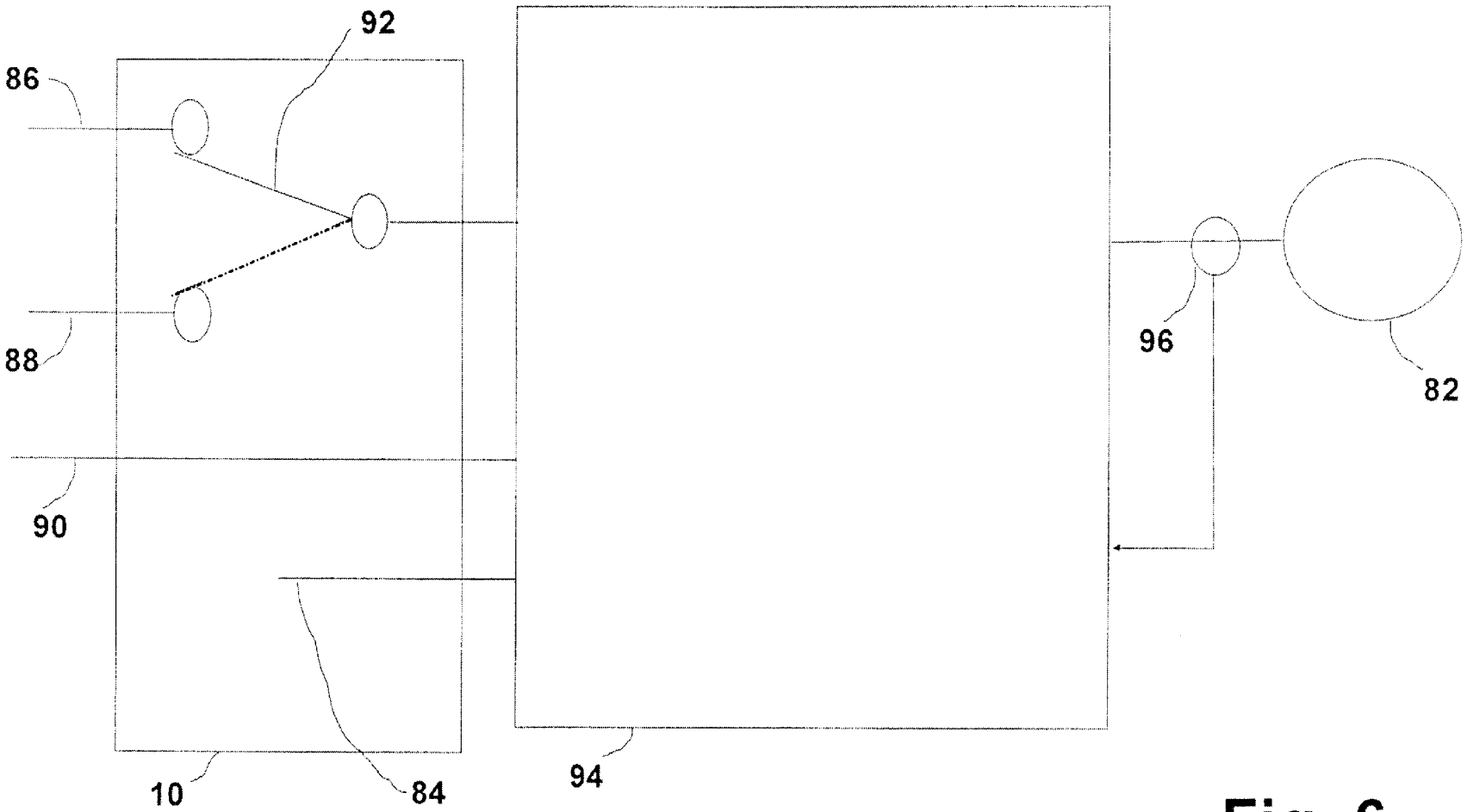
FIG. 6 represents a control circuit of the motor.

The motorized module control circuit 83 can be seen in FIG. 6. Passage of the operating member 18 via an indexed stopping position, situated between the open, loaded position and a closing dead point position of the mechanism and represented in FIG. 4 is detected by an auxiliary switch 84 or micro-contact. As a reminder, the closing dead point position is the position of the operating member 18 corresponding to alignment of the direction 72 of the force applied by the storage spring 70 on the swivel pin 54 with a plane containing the two swivelling spindles 52, 54 of the upper connecting rod 50, when the bar 40 is in the separated position represented in FIG. 3. When the operating member 18 passes beyond the closing dead point in the direction of the closed position and leaves the angular friction sector, the spring 70 becomes driving. The indexed stopping position of FIG. 4 is situated a few degrees from the closing dead point position, between the closing dead point position and the open, loaded position represented in FIG. 3. Three electrical control lines 86, 88, 90 enable the operator or an automated electrical power distribution control centre to respectively transmit an opening order, a resetting order, and a closing order from a remotely located control interface or any other means. A changeover switch 92 located in the circuit breaker enables either the opening order or the resetting order to be transmitted. This changeover switch is activated by movement of the latch 44 or of any other element of the mechanism representative of the tripped or not state of the switchgear unit. The changeover switch 92 is in the position represented in an unbroken line in FIG. 6 when the latch 44 is latched to the tongue 58. The changeover switch 92 switches to the position represented in a broken line when the circuit breaker is tripped, the latch 44 being in the position of FIG. 5. A logic unit 94 receives these signals, and also a signal representative of the intensity of the supply current to the motor 82, delivered by a current sensor 96, and controls the intensity of the supply current to the motor 82. Operation of the Device is as Follows.

We will assume initially that the device is in the closed position represented in FIG. 2. The main circuit of the circuit breaker is then closed, the contact bridge 38 providing the current flow between the connecting strips 34 and 36. The latch 44 is engaged in a notch of the tongue 58, itself blocked by the latching lever 62.

A cycle comprising opening on an electrical fault, resetting then a closing order of the switchgear unit will first be dealt with.

When an electrical fault, short-circuit current, undervoltage, etc. . . . is determined by the switchgear unit trip device, an electromechanical actuator, not shown, makes the latching lever 62 swivel, releasing the tongue. The latch 44 then repels the tongue 58 and is released. The spring 70 of the mechanism discharges as it contracts, moving the rod system 46, 50 and latch 44 to the tripped position represented in FIG. 5. The bar 40 swivels around its axis 42 and opens the power circuit of the circuit breaker. The operating member 24 remains immobile. The auxiliary changeover switch 92 switches to the position represented in a broken line in FIG. 6 due to the movement of the latch 44.

Figure 7:
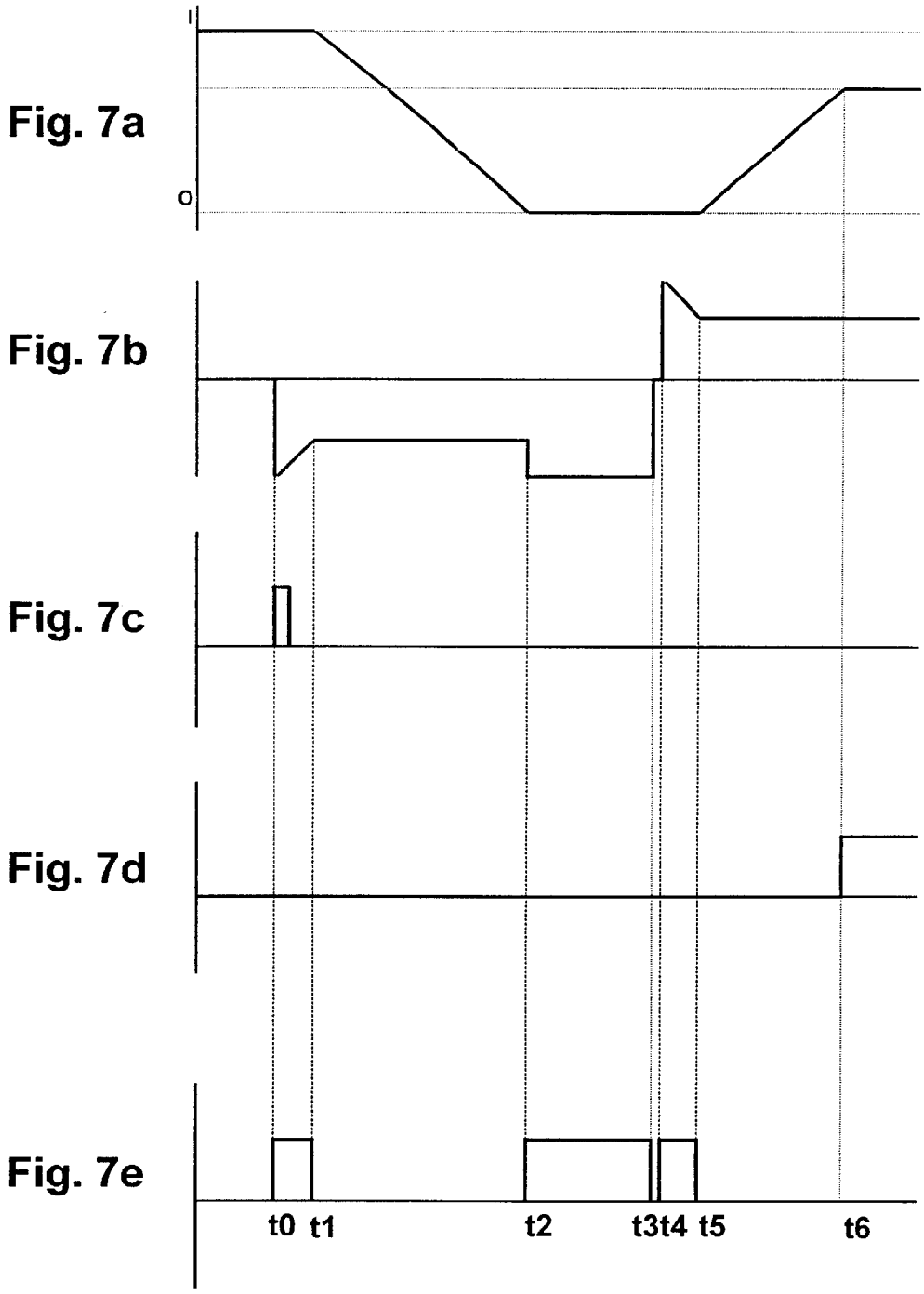
FIGS. 7*a* to 7*e* represent different time diagrams of control of the motor, when an opening and resetting phase takes place.

A resetting sequence takes place from this position, the chronology of which sequence is illustrated by the time diagrams of FIGS. 7*a* to 7*e*, in which the y-axes respectively indicate: the position of the switchgear unit operating member 18 in FIG. 7*a*; the intensity of the motor supply current in FIG. 7*b*; the state of the opening order transmission line 86 in FIG. 7*c*; the state of the means 84 for detecting passage via the intermediate stopping position in FIG. 7*d*; and detection by the sensor 96 of a current intensity threshold overshoot in FIG. 7*e*. The sequence is initiated by a resetting order received by the control module on the line 88 at the time to and visualized in FIG. 7*c*. The logic unit 94 makes the motor operate in a resetting direction. As the counter-electromotive force of the motor is nil at rest, the supply current intensity (FIG. 7*b*) exceeds the detection threshold for a few moments, which is detected by the sensor (FIG. 7*e*). However, the logic unit compares the time during which this threshold is exceeded with a time delay constant. As the inrush current to the motor is transient and has a shorter duration than the time delay constant, the logic unit does not modify the order. The motor continues to be supplied and, as from the time $t_1$, causes the operating member to swivel from the position of FIG. 3 to the position of FIG. 4, as represented schematically in FIG. 7*a*. When the operating member comes up against the stop, at the time $t_2$, the motor is blocked and the supply current increases again to overshoot the detection threshold. As soon as the detection time exceeds the time delay constant, the power supply of the motor is cut (at the time $t_3$) for a short moment, before being reversed at the time $t_4$. Power supply of the motor at rest again causes a current peak that is attenuated when the rotor is set in motion, so that the duration of the peak (from the $t_4$ to the time $t_5$) is shorter than the time delay constant and the logic unit does not modify the power supply to the motor. The motor then drives the operating member from the open loaded position of FIG. 3 to the indexed intermediate position of FIG. 4. On reaching this position at the time $t_6$, the operating member actuates the auxiliary switch (FIG. 7*d*) which switches to its live (On) state. This event is detected by the logic unit which stops power supply of the motor. The motor has hardly any inertia and stopping is practically immediate, all the more so as the energy storage spring tends to urge the operating member to the open loaded position. When it is stopped in the position of FIG. 4, the operating member is then a few degrees from the closing dead point of the mechanism, urged to its open loaded position by the storage spring. The irreversible nature of the transmission stage 76 achieved by the bevel gear 24 and endless screw 74 performs blocking in this position and prevents the storage spring from causing a return to the open loaded position. The switchgear unit is then in a ready to close state, awaiting a closing order.

Figure 8:
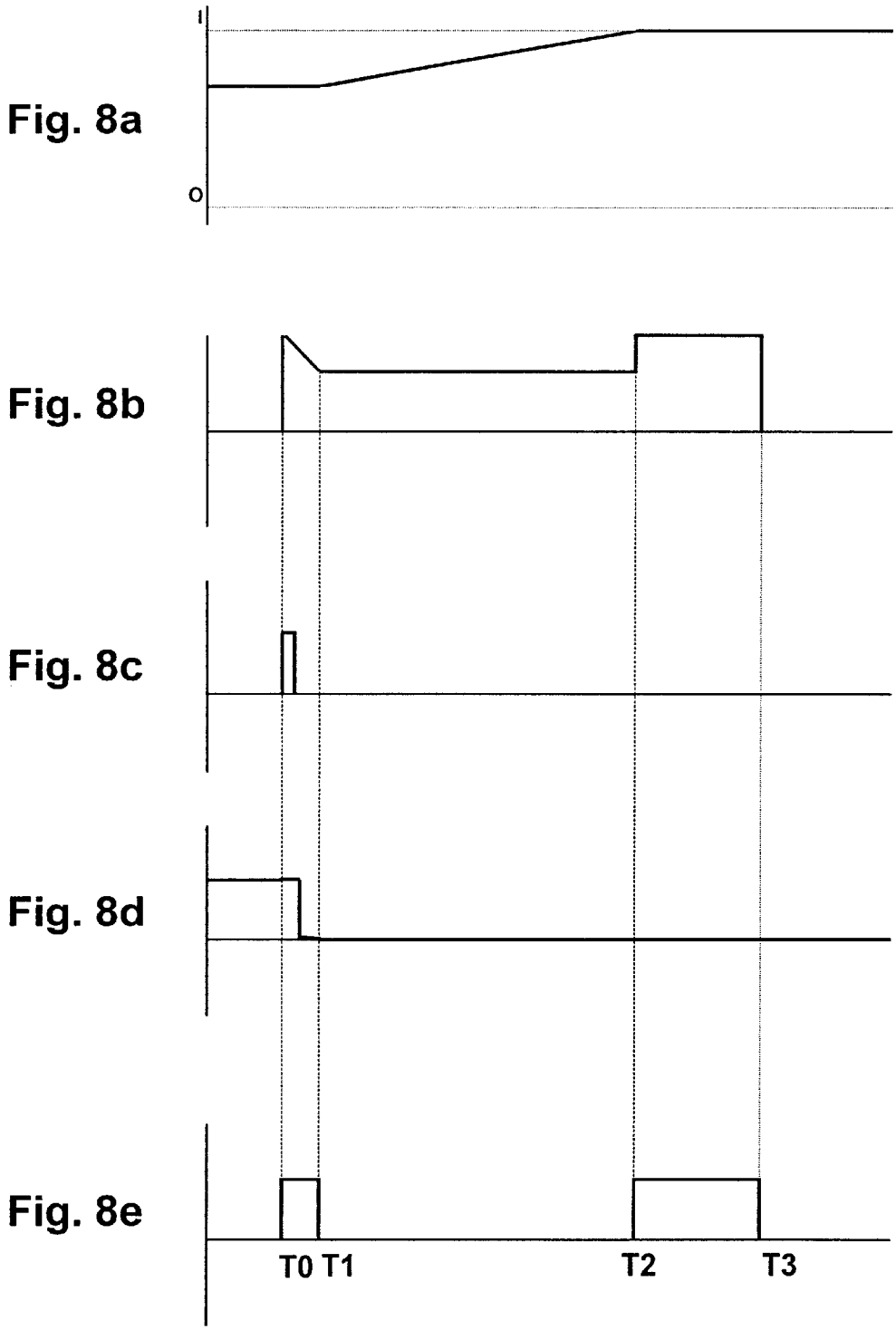
FIGS. 8*a* to 8*e* represent different time diagrams of control of the motor, when a closing phase takes place.

From this position, a closing order on the closing line makes the mechanism switch from the state represented in FIG. 4 to that represented in FIG. 2, according to the sequence illustrated in the time diagrams of FIGS. 8*a* to 8*e* in which the y-axes respectively indicate: the position of the switchgear unit operating member 18 in FIG. 8*a*; the intensity of the motor supply current in FIG. 8*b*; the state of the opening order transmission line 90 in FIG. 8*c*; the state of the means 84 for detecting passage via the intermediate stopping position in FIG. 8*d*; and detection by the sensor 96 of a current intensity threshold overshoot in FIG. 8*e*.

At the time $T_0$, a closing order is detected on the line 90 (FIG. 8*c*) and the logic unit activates the motor (FIG. 8*b*). The initial power supply of the shut-down motor causes a current peak up to the time $T_1$. This peak is detected (FIG. 8*e*) but the logic unit does not modify the order as the duration of the peak ($T_1$–$T_0$) is shorter than the time delay constant. The motor drives the operating member to the closed position. Starting of the motor is all the more fast as the unit is close to the closing dead point, so that the force opposed by the storage spring is weak. As soon as the operating member 18 passes the closing dead point and leaves the angular friction sector, the storage spring 70 becomes driving and drives the rod system and bar in impulse manner to the closed position represented in FIG. 2, independently from the progression of the operating member 18. The operating member 18 continues its movement to the closed position of FIG. 2, where it is blocked by an end-of-travel stop at the time $T_2$. As the motor shaft is again blocked, the supply current intensity increases and exceeds the detection threshold. After a time corresponding to the time delay constant, the logic unit stops the power supply at the time $T_3$. The device is then at rest in the state of FIG. 2.

An opening cycle on an opening and closing order of the circuit breaker will now be described. The switchgear unit being initially in the closed position of FIG. 2, an opening order is transmitted on the line 86. This line is live (On) as the auxiliary switch 92 is in the position represented in an unbroken line in FIG. 6. From the control point of view, this order is treated as the resetting order. The logic unit runs the complete cycle moving the operating member to the open loaded position, then to the indexed position close to the closing dead point. When a closing order is given, the device responds as in the previous case.

The presence of three distinct lines 86, 88, 90 for transmission of the opening, resetting and closing orders respectively is dictated by practice which imposes specific access conditions to the resetting control line 88. The resetting control line 88 is in fact used in the case where the circuit breaker has tripped on a fault. In such a case, the operator who is to perform the operation to clear the fault on the electrical circuit protected by the circuit breaker, before beginning his operation, must be able to prevent the circuit breaker from resetting throughout this maintenance operation, which is achieved for example by padlocking the control button of the line 88.

The order described above only requires a changeover switch 92 and an auxiliary switch 84 to detect the indexed position. It is therefore particularly reliable. However, the operating member 18 covers a non-useful distance to the loaded position in the case where opening was not caused by tripping of the switchgear unit. The opening—closing sequence time is therefore not optimized.

Figure 9:
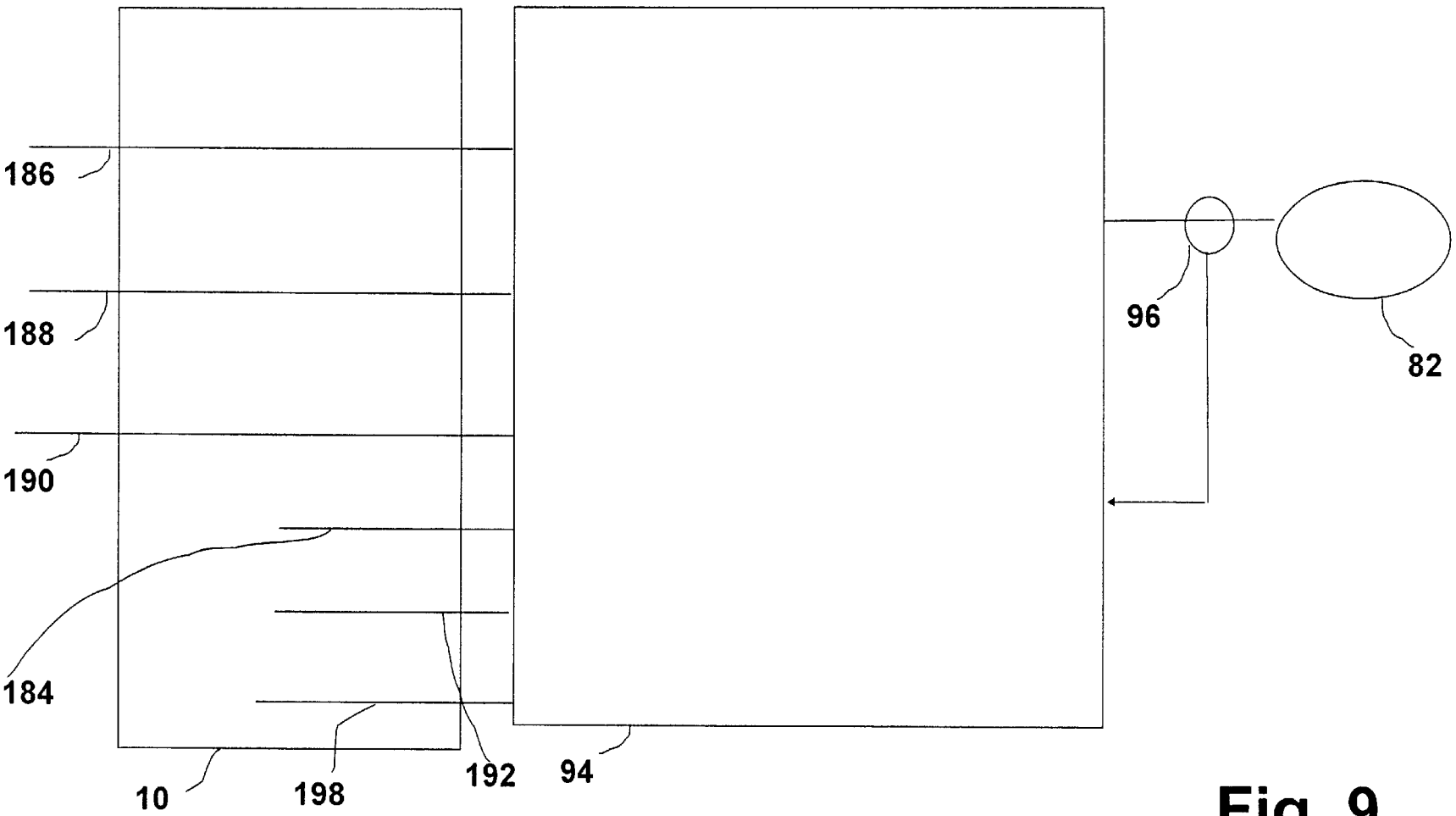
FIG. 9 represents a control circuit of the motor according to a second embodiment of the invention.
Figure 10:
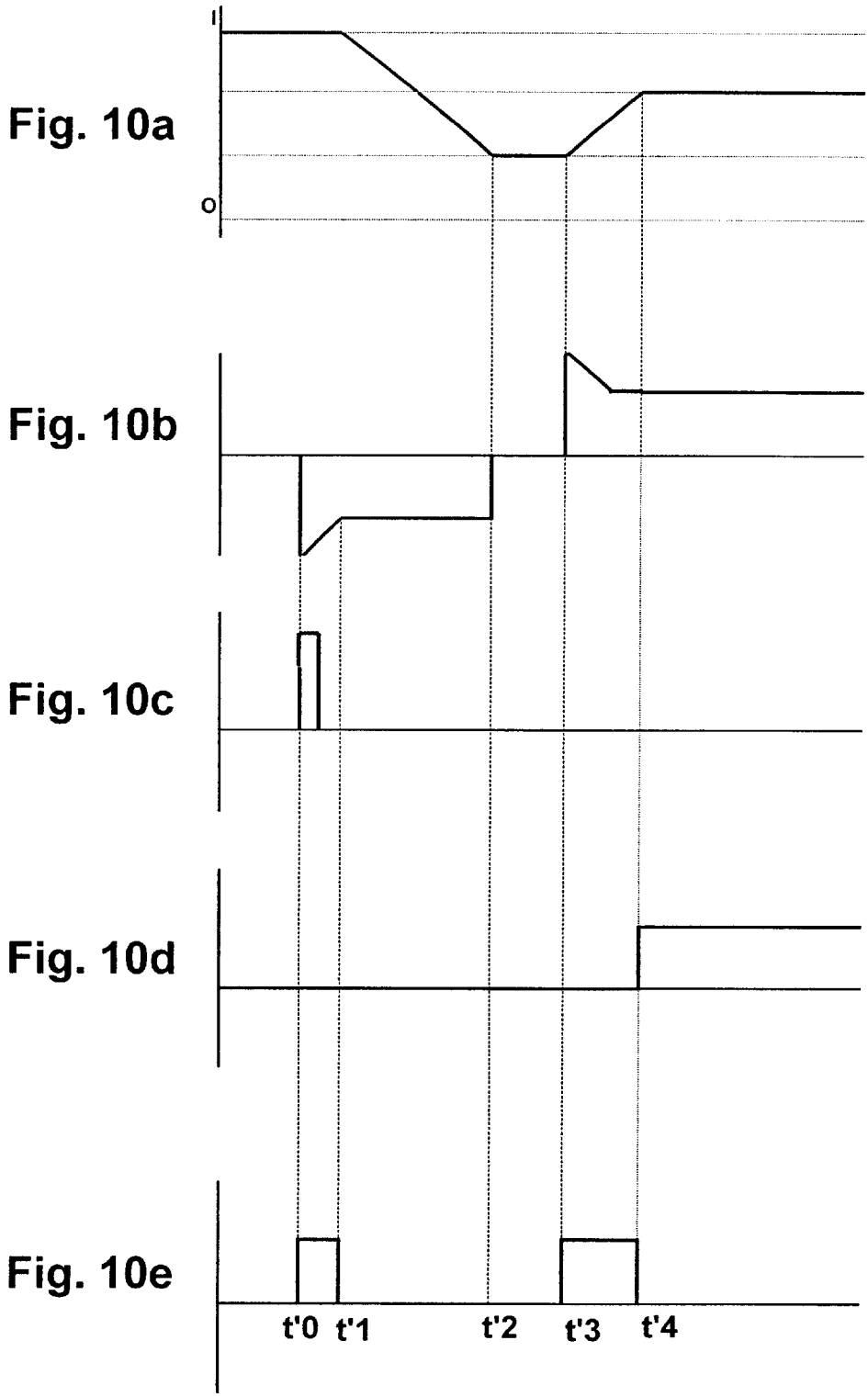
FIGS. 10*a* to 10*e* represent different time diagrams of control of the motor, when an opening and resetting phase takes place according to the second embodiment.
Figure 11:
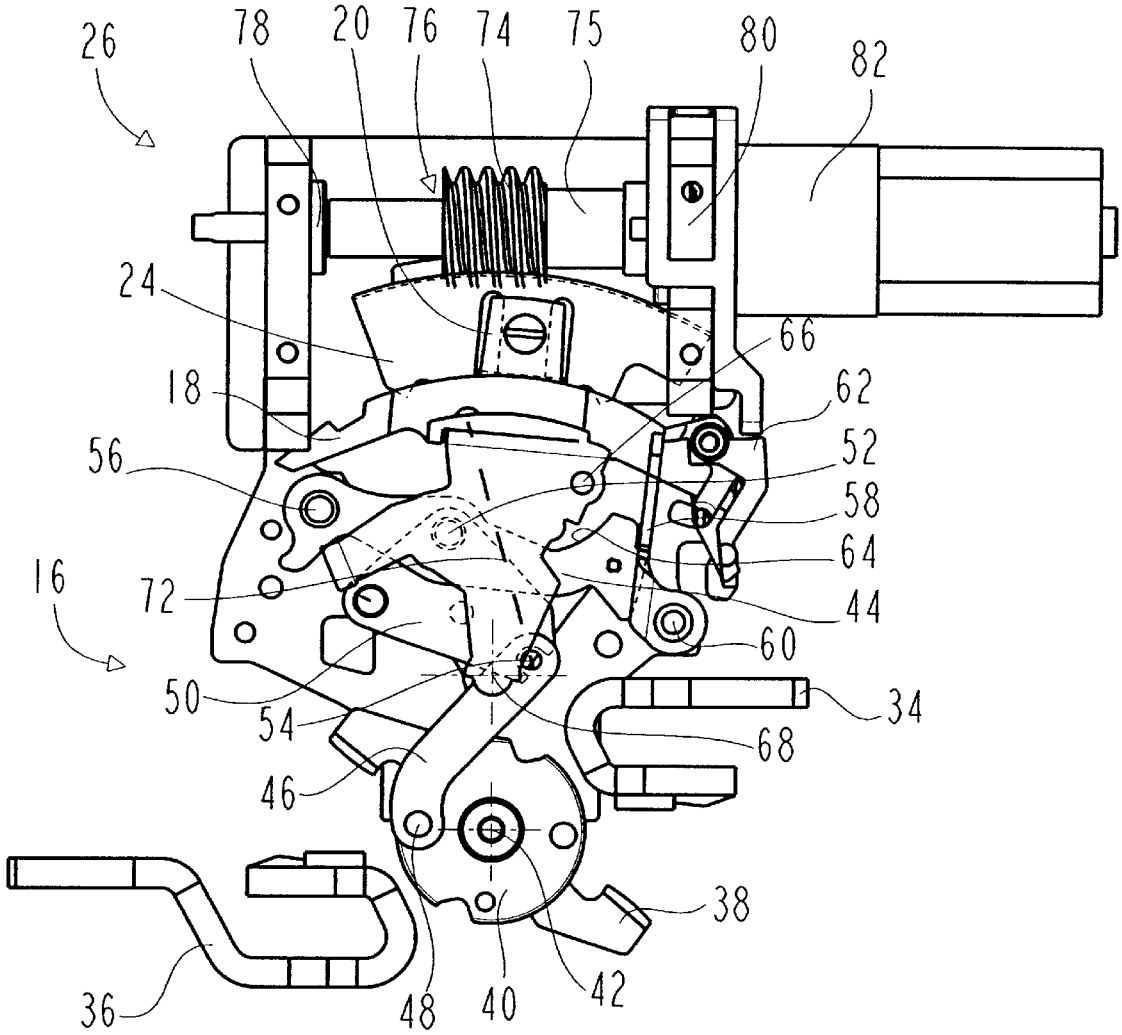
FIG. 11 represents a similar view to that of FIG. 2, in an indexed turning position of the switchgear unit according to the second embodiment.

According to an alternative embodiment described in FIGS. 9 to 11, it is proposed to minimize the travel of the operating member 18 in the opening—closing sequence.

For this, the logic unit receives the signals from the opening control line 186, from the resetting control line 188, and of tripped state detection 192, independently from each other. The logic unit in addition receives a signal from an auxiliary switch 198 changing state when the operating member overshoots an indexed position, represented in FIG. 11 and situated close to an opening dead point. The opening dead point position, situated between the closing dead point position and the open loaded position, is the position corresponding to alignment of the energy storage spring with a plane containing the swivelling axes of the upper connecting rod, when the contacts are in the contact position. This is, apart from the friction cone, the position from which the storage spring becomes driving to move the bar to the separated position. The indexed position is situated between the opening dead point and the open loaded position, so that when the change of state of the auxiliary switch is detected, it is certain that separation of the contacts has taken place.

When the tripped state is detected, the opening control line information is not processed. The order on the resetting line is processed as in the first embodiment according to the diagram of FIG. 7.

When the non-tripped state is detected, the order on the resetting line is not processed. In this case, an order on the opening control line is processed in a specific manner as described below by means of the diagrams of FIG. 10. The motor drives the operating member from the closed position to the open loaded position, but stops before reaching this position, as soon as the contact position detector detects opening of the contacts at the time $t'_2$, which translates the fact that the mechanism has passed beyond its opening dead point. The logic unit can then reverse the direction of running of the motor, without waiting for a time delay constant to elapse, to bring the operating member to the intermediate stopping position at the time $t'_4$. The motor stops when this position is detected. The switchgear unit is then in the ready to close state.

According to another alternative embodiment, not represented, the means for detecting passage via the opening dead point are replaced by a switching bar position detector. Operation of the device is the same as that described in FIG. 10, detection of the position of the bar corresponding to separation of the contacts replacing the signal of passage via the opening dead point.

Figure 12:
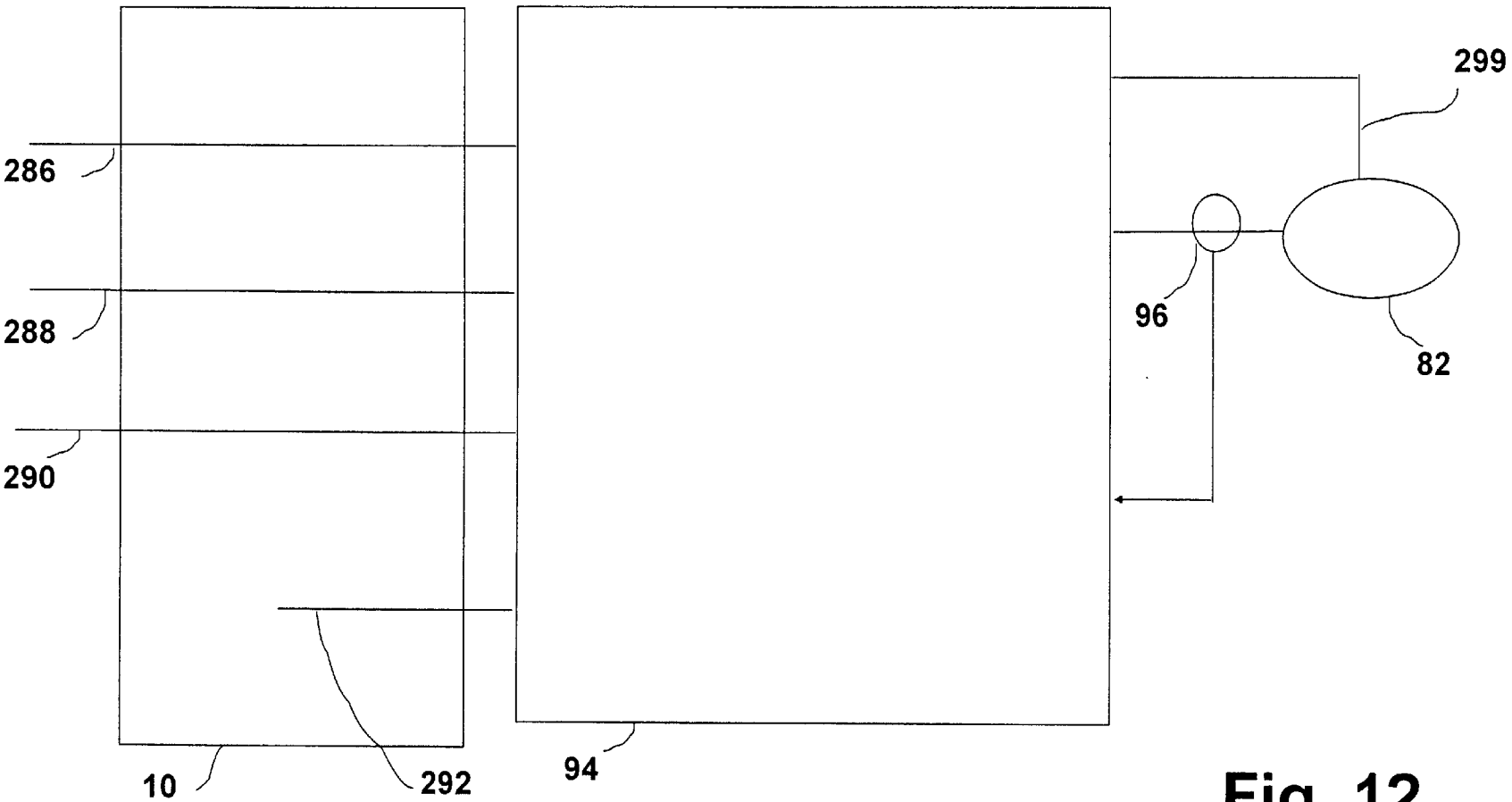
FIG. 12 represents a control circuit of the motor according to a third embodiment of the invention.

According to another alternative embodiment illustrated in FIG. 12, the motor is a stepper motor controlled in the angular position, possibly with position detection by a specific sensor 299. The logic unit then controls the positioning of the motor according to the orders given on the opening control line 286, the resetting control line 288, and the closing control line 290 and on the state of the means 292 for detecting the tripped state of the switchgear unit. Position control of the motor makes it possible to eliminate the means for detecting passage via the closing dead point and, if this is the case, the means for detecting passage via the opening dead point, and also the means for detecting end of closing travel and end of resetting travel.

Figure 13:
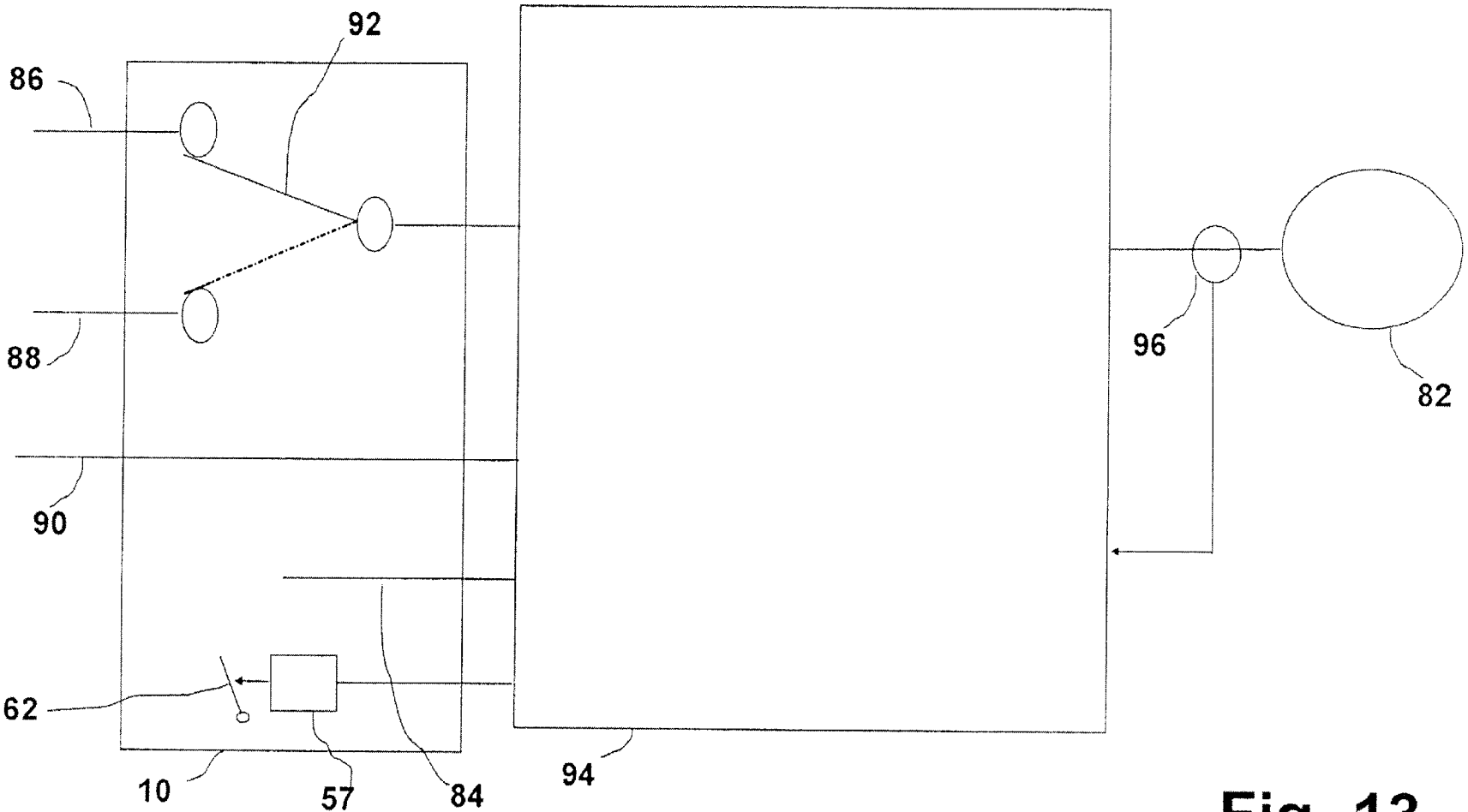
FIG. 13 represents a control circuit of the motor according to a fourth embodiment of the invention.

It could naturally also be envisaged not to leave the operating member in the position of FIG. 2 when the switchgear unit is closed but to move the handle to a position close to the opening dead point, between the opening dead point and the closed position. This would have the advantage of speeding up the opening and resetting phases. However, such an arrangement would have the major drawback of affecting the contact pressure of the contact bridge. To speed up opening on an opening order, it is therefore preferred, according to a variant of the first embodiment illustrated in FIG. 13, to transmit the opening order directly to the logic unit which then actuates an actuator 57 making the latching lever 62 swivel to release the tongue 58 and perform tripping of the mechanism. Opening times of about 20 ms are then obtained. At the same time, the motor 82 is started according to the resetting sequence described in the first embodiment.

Various other modifications are naturally possible.

The invention is applicable to both single-break switchgear units and to double-break switchgear units. The switchgear unit can have any number of pole-units.

The motor used can be of any type accepting operation with a blocked rotor for a few hundred milliseconds without its performance being adversely affected.

In the above embodiments, end of closing or opening travel is detected by the supply current intensity overshooting a given threshold for a time exceeding a given time constant. It can also be envisaged to detect the ends of travel by auxiliary switches identical to those used to detect the indexed dead point positions. However, this alternative has the shortcoming of increasing the number of auxiliary switches, and therefore of reducing the reliability of the device.

What is claimed is:

1. An electrical switchgear unit comprising:

a pair of separable contact means, comprising at least one movable contact means movable between a contact position and a separated position;

an opening and closing mechanism of the switchgear, comprising:

a primary member movable in a closing direction from a loaded position to a closed position passing via an intermediate closing dead point position, the movable contact means being in the separated position when the primary member is in the loaded position, an energy storage spring arranged in such a way that the primary member loads the storage spring when passing from the loaded position to the closing dead point position, and that the storage spring discharges driving the movable contact means to the contact position when the primary member passes beyond the closing dead point in the closing direction;

an electric motor controlled by control means;

an irreversible kinematic transmission system between the electric motor and the primary member, such that the electric motor can drive the primary member but the primary member can not drive the electric motor, the motor running in a closing direction to drive the primary member in the closing direction;

wherein the control means comprise means for detecting passage of the primary member via an indexed intermediate stopping position between the loaded position and the closing dead point position and for stopping the motor when the motor drives the primary member in the closing direction and the primary member reaches the indexed stopping position.

2. Switchgear unit according to claim 1, wherein the indexed stopping position is closer to the closing dead point position than to the loaded position.

3. Switchgear unit according to claim 1, wherein the control means comprise an auxiliary switch changing state when the primary member passes via the indexed stopping position.

4. Switchgear unit according to claim 1, wherein the control means comprise means for detecting the fact that the primary member is in the closed position whereas the motor is controlled to run in the closing direction, and for stopping the motor in this case.

5. Switchgear unit according to claim 1, wherein the motor is a DC motor supplied by a supply current controlled by the control means, the control means comprise means for detecting the fact that the intensity of the supply current remains higher than a preset threshold during a preset time whereas the motor is supplied to run in the closing direction, and for interrupting the power supply of the motor in this case.

6. Switchgear unit according to claim 1, wherein:

the primary member is movable in an opening direction that is the reverse of the closing direction, from the closed position to the setting position, passing via an intermediate opening dead point position, the energy storage spring loading when passing from the closed position to the opening dead point position when the movable contact is in the contact position and discharging driving the movable contact means to the separated position when the primary member continues its movement in the opening direction beyond the opening dead point position;

the motor is mobile in an opening direction that is the reverse of the closing direction, to drive the primary member in the opening direction;

the control means comprise means for detecting the fact that the primary member, driven by the motor in the opening direction, passes via an indexed turning position, and for reversing the direction of rotation of the motor in this case.

7. Switchgear unit according to claim 6, wherein the indexed turning position is the loaded position.

8. Switchgear unit according to claim 7, wherein:

the motor is a DC motor supplied by a supply current controlled by the control means, the control means comprise means for detecting the fact that the intensity of the supply current of the motor remains higher than a preset threshold during a preset time whereas the motor is supplied to run in an opening direction that is the reverse of the closing direction, and for changing the direction of rotation of the motor in this case.

9. Switchgear unit according to claim 6, wherein the indexed turning position is an intermediate position between the opening dead point position and the loaded position, closer to the opening dead point position than to the loaded position.

10. Process for controlling an electrical switchgear unit comprising:

a pair of separable contact means, comprising at least one movable contact means movable between a contact position and a separated position;

an opening and closing mechanism of the switchgear unit, comprising:

a primary member movable in a closing direction from a loaded position to a closed position passing via an intermediate closing dead point position, the movable contact means being in the separated position when the primary member is in the loaded position, an energy storage spring arranged in such a way that the primary member loads the storage spring when passing from the loaded position to the closing dead point position, and that the storage spring discharges driving the movable contact means to the contact position when the primary member passes beyond the closing dead point in the closing direction;

an electric motor controlled by control means, the motor running in a closing direction to drive the primary member in the closing direction; process comprising an opening procedure of the switchgear unit comprising:

a preparing for closing stage, wherein the motor drives the primary member in the closing direction up to an indexed intermediate stopping position situated between the loaded position and the closing dead point position, and stops in the intermediate stopping position.

11. Process according to claim 10, wherein the opening procedure comprises in addition an opening stage preceding the preparing for closing stage and wherein the movable contact means is moved to the separated position and wherein the motor drives the primary member in an opening direction opposite to the closing direction up to an indexed turning position.

12. Process according to claim 11, wherein the indexed turning position is the loaded position.

13. Process according to claim 12 for an electrical switchgear unit the mechanism whereof comprises in addition a latching member movable between a latched position and an unlatched position, the latching member being in the latched position when the movable contact means is in the contact position;

a trip latch operated by an actuator, the trip latch performing latching of the latching member in the latched position, the storage spring tending to simultaneously drive the latching member from the latched position to the unlatched position and the movable contact means from the contact position to the separated position when the latch releases the latching member;

process wherein, in the opening stage, the movable contact means is moved to the separated position by commanding the actuator which unlatches the latch to release the latching member.

14. Process according to claim 11, wherein the indexed turning position is situated between the loaded position and an opening dead point position situated between the closing dead point position and the loaded position, the storage spring loading as it passes from the closed position to the opening dead point position when the movable contact is in the contact position and discharging driving the movable contact means to the separated position when the primary member continues its movement in the opening direction passing beyond the opening dead point to the indexed turning position.

15. Process according to claim 10, wherein in response to a closing order subsequent to the opening order, the motor drives the primary member from the intermediate stopping position to the closed position.

* * * * *